US005220395A

United States Patent [19]

Yamashita et al.

[11] Patent Number: 5,220,395

[45] Date of Patent: Jun. 15, 1993

[54] IMAGE FORMING APPARATUS CAPABLE OF INDICATING ORIENTATIONS FOR SETTING ORIGINAL DOCUMENTS

[75] Inventors: Toshiyuki Yamashita; Masazumi Ito, both of Osaka, Japan

[73] Assignee: Minolta Camera Co., Ltd., Osaka, Japan

[21] Appl. No.: 808,033

[22] Filed: Dec. 11, 1991

Related U.S. Application Data

[63] Continuation of Ser. No. 410,143, Sep. 20, 1989, abandoned.

[30] Foreign Application Priority Data

Sep. 21, 1988 [JP] Japan ..... 63-237088
Dec. 9, 1988 [JP] Japan ..... 63-310611

[51] Int. Cl.[5] ..... G03G 21/00

[52] U.S. Cl. ..... 355/313; 355/25; 355/209; 355/230

[58] Field of Search ..... 355/309, 308, 313, 311, 355/202, 203, 206, 208, 209, 24, 25; 271/9; 340/709, 718

[56] References Cited

U.S. PATENT DOCUMENTS 4,017,173 4/1977 Komori et al. .
4,145,138 3/1979 Mercure ..... 355/25
4,406,537 9/1983 Mori ..... 271/145 X
4,579,445 1/1986 Hasegawa ..... 355/243
4,595,273 6/1986 Watanabe et al. .
4,597,662 7/1986. Hirgta et al. ..... 355/209
4,727,401 2/1988 Partilla et al. .
4,731,637 3/1988 Acquaria et al. .
4,739,369 4/1988 Yoshiura et al. ..... 271/3.1 X
4,739,372 4/1988 Watanabe ..... 355/25
4,764,789 8/1988 Iwaki et al. ..... 355/209
4,804,997 2/1989 Mizude et al. ..... 355/25 X
4,941,017 7/1990 Mishima et al. ..... 355/218
4,958,198 9/1990 Hamakawa ..... 355/309
4,972,271 11/1990 Koumura ..... 358/300
5,008,712 4/1991 Inuzuka et al. ..... 355/206
5,023,663 6/1991 Shibazaki et al. ..... 355/243

FOREIGN PATENT DOCUMENTS 0053827 3/1984 Japan ..... 355/25

*Primary Examiner*—A. T. Grimley
*Assistant Examiner*—T. A. Dang
*Attorney, Agent, or Firm*—Willian Brinks Olds Hofer Gilson & Lione

[57] ABSTRACT

An image forming apparatus capable of indicating document orientation for a reference to set an original document on a document platen, the image forming apparatus including a document orientation display member for displaying the document orientation at a normal copy mode in a normal display form in which the document orientation coincides with an orientation of a fed copy sheet, and at a specific copy mode which differs from the normal copy mode in a specific display form which differs from the normal display form at the normal copy mode.

11 Claims, 15 Drawing Sheets lengthwise widewise a
B
A
original book copy mode
c
B
copy
b
A
copy d
D
original
e
C
original 2 in 1 copy mode
D
f
C
copy

IMAGE FORMING APPARATUS CAPABLE OF INDICATING ORIENTATIONS FOR SETTING ORIGINAL DOCUMENTS

This application is a continuation of application Ser. No. 07/410,143, filed Sep. 20, 1989, now abandoned.

BACKGROUND OF THE INVENTION

1. Field of the Invention

The present invention relates to an image forming apparatus capable of indicating orientations for setting original documents.

2. Description of Related Arms

Conventional copiers are provided with a means for indicating the direction (length or width directional orientations) in which an original document is set on a document platen. These copiers display the directional orientation of a fed copy sheet to be the same direction as the direction in which the original document is set.

In the present invention, the directions in which the original document may be set are the length and width directions and are defined below.

WIDTHWISE ORIENTATION: The direction wherein the short (width) side of the original document is oriented in the copy sheet transport direction Y as said original document is placed on the glass document platen 8, as shown in FIG. 4*a*.

LENGTHWISE ORIENTATION: The direction wherein the long (length) side of the original document is oriented in the copy sheet transport direction Y as said original document is placed on the glass document platen 8, as shown in FIG. 4*b*.

Conventional copiers capable of being set in special copy modes such as book copy mode (also called divisional copy mode), 2-in-1 copy mode and the like, are disclosed in U.S. Pat. Nos. 4,017,173 and 4,771,319 and others.

In the book copy mode a single sheet original document "a" having two image regions A and B is reproduced so that the image regions A and B are copied onto separate copy sheets c and b respectively, as shown in FIGS. 5*a* and 5*b*.

In the 2-in-1 copy mode two original documents are continuously transported by means of an automatic document feeding means (ADF) or the like so as to be placed adjacently one to the other as if forming a single sheet document, and the two original document images are copied onto a single copy sheet, as shown in FIGS. 5*c* and 5*d*.

In copiers having the book copy mode and 2-in-1 copy mode, confusion occurs when indicating (displaying) the orientation in which the original document is set as previously described. That is, in the book copy mode the original document "a" is oriented in the lengthwise direction, while the orientation of both the fed copy sheets b and c is in the widthwise direction, as can be readily understood from the drawing. Thus, if the display indicates the same direction as the fed copy sheet direction, the display will contradict the actual orientation in which the original document is set.

Therefore, when the operator refers to the display that indicates the orientation of the original document as s/he sets the placement of the document, confusion will result because the operator will not know if the display indicates a set direction for a single page of the document (either image region A or B) or that for the document in its entirety (both image regions A and B).

As is clearly shown in the drawings, the aforesaid problems are also common to the 2-in-1 copy mode described in FIGS. 5*c* and 5*d*.

In the 2-in-1 copy mode the direction in which copy sheet f is set is in a lengthwise orientation, while the original documents d and e are set in a widthwise orientation.

Further, because the copy sheet feed direction is optionally selectable when the operator manually feeds the copy sheet and performs a copy operation with the copier in the manual mode, the preset displayed original document set direction is erroneous and can only result in operator confusion.

The present invention is designed to eliminate the aforesaid problems.

SUMMARY OF THE INVENTION

Accordingly, a main object of the present invention is to provide an improved image forming apparatus which eliminates the previously described disadvantages.

A further object of the present invention is to provide an image forming apparatus which prevents operator confusion by changing the method of displaying the original document orientation (set direction) in accordance with the selected copy mode.

A still further object of the present invention is to provide an image forming apparatus capable of determining the display direction for document orientation (set direction) by means of the selected copy mode.

These and other objects are attained by an image forming apparatus having a document orientation display means for displaying document orientation, said document orientation display means displaying the document orientation at a normal copy mode in a normal display form in which the document orientation coincides with an orientation of a fed copy sheet;

a mode setting means for setting a specific copy mode that differs from the normal copy mode, and a control means, when the specific copy mode is set by the mode setting means, for controlling the document orientation display means so as to display in a specific display form which differs from the normal display form at the normal copy mode.

In accordance with another aspect of the present invention, there is provided an image forming apparatus having a document orientation display means for displaying document orientation, said document orientation display means displaying the document orientation at a normal copy mode in a normal display form in which the document orientation coincides with an orientation of a fed copy sheet, a mode setting means for setting a specific copy mode in which the document orientation is different from an orientation of a fed copy sheet, and a control means for deactivating the document orientation display means when the specific copy mode is set by the mode setting means.

In accordance with another aspect of the present invention, there is provided an image forming apparatus having a document orientation display means for displaying document orientation, said document orientation display means displaying the document orientation at a normal copy mode in a normal display form in which the document orientation coincides with an orientation of a fed copy sheet, an automatic document feeding means for feeding original documents set in a document tray to a document platen, a specific copy mode setting means for setting a specific copy mode wherein two original documents are simultaneously set on the document platen by the automatic document feeding means and images of two original documents are reproduced on a single copy sheet, and a display control means, when the specific copy mode is set by the specific copy mode setting means, for controlling the document orientation display means so as to display an orientation different from that of the fed copy sheet as the document orientation.

DESCRIPTION OF THE DRAWINGS

These and other objects or features of the present invention will become apparent from the following description of preferred embodiments thereof taken in conjunction with the accompanying drawings, in which.

In the following description, like parts are designated by like reference numbers throughout the several drawings.

DESCRIPTION OF THE PREFERRED EMBODIMENTS

The preferred embodiments of the present invention are hereinafter described with reference to the accompanying drawings.

Figure 1:
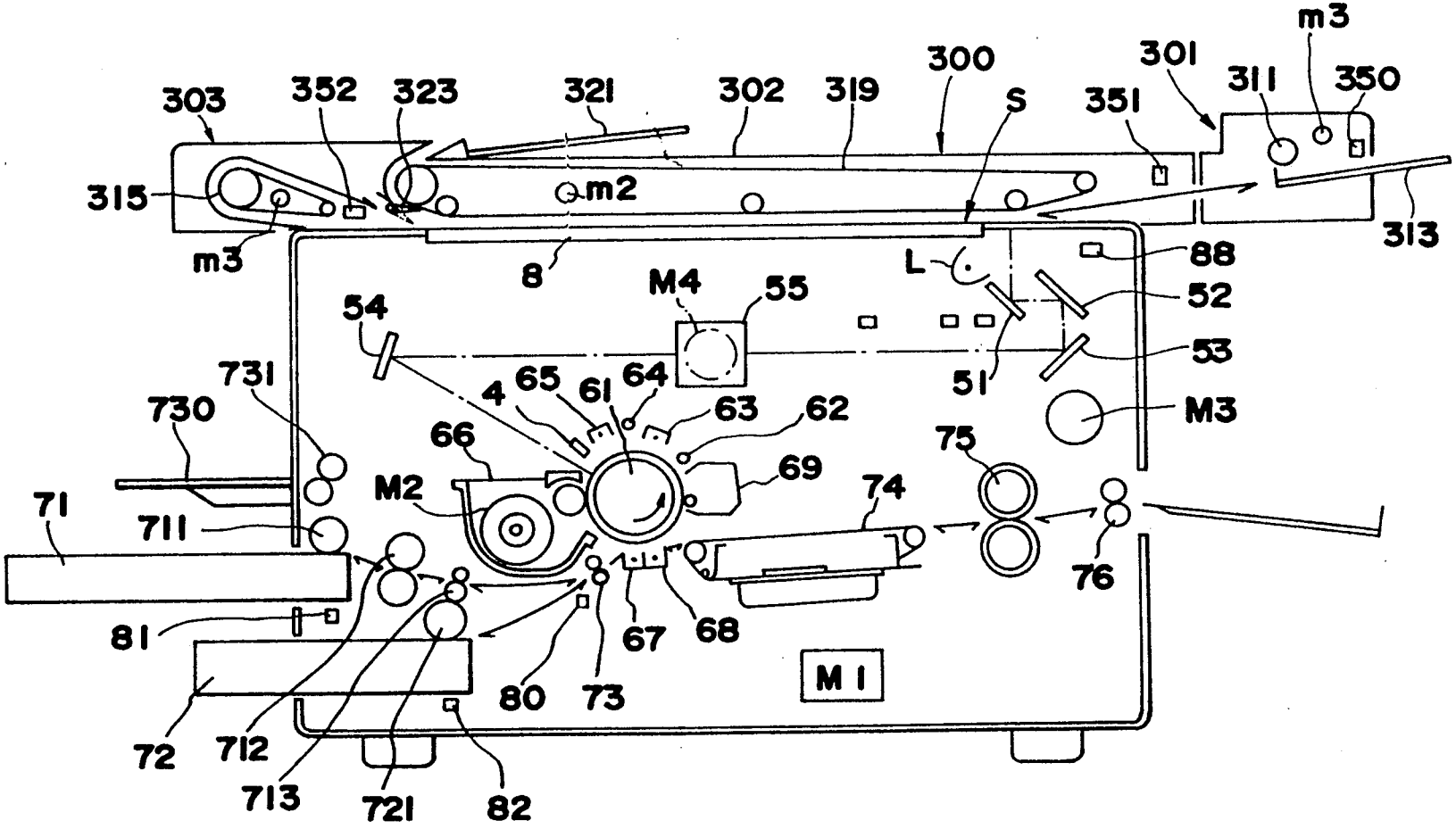
FIG. 1 is a section view of a copier incorporating the present invention.

FIG. 1 is a cross section view showing the construction of a copier incorporating the present invention.

The copier shown in the drawings is provided with an automatic document feeder (ADF) 300 on the top. The copier and the ADF 300 are electrically connected.

The copier is provided with an optical system in the upper section and image forming and paper feed portions in the lower section.

The optical system scans an original document placed on the glass document platen with exposure light, and the light reflected from the document surface forms an image on the surface of photoconductive drum 61 in the image forming portion.

The optical system comprises an exposure lamp L, reflecting mirrors 51, 52, 53, 54 and lens 55. The exposure lamp L and reflecting mirror 51 travel along the undersurface of the glass document platen 8 at a speed of V/N (where V is the peripheral speed of the photoconductive drum 61 and N is the copy magnification), and reflecting mirrors 52 and 53 likewise travel the same path at a speed of V/2N. Copy magnification is set by regulating the positions of lens 55 and reflecting mirror 54, and the image position is corrected by angular adjustment of reflecting mirror 54.

The image forming portion forms images using a so-called electrophotographic process.

That is, the electrostatic latent image formed on the surface of photoconductive drum 61 is developed with toner, the toner image is transferred to the copy sheet, fixed thereon and discharged from the copier.

The image forming portion is provided with a photoconductive drum 61 which is rotatable in the counterclockwise direction in the drawing, and arranged around the periphery of said photoconductive drum 61 are eraser lamps 62 and 64, chargers 63 and 65, image interval eraser 4, developing device 66, transfer charger 67, separation charger 68, cleaning device 69, belt 74 to transport the copy sheet carrying the transferred toner image, and fixing unit 75 which fuses the toner image onto the transported sheet. Item 73 in the drawing is a timing roller set for transporting the fed copy sheet between the photoconductive drum and the transfer charger with a specific timing so that the fed sheet is synchronized with the rotation of the photoconductive drum. Item 76 is a discharge roller set for discharging the copy sheet carrying the fixed image thereon from the image forming portion.

The copy sheet supply portion is provided a top paper tray 71 and bottom paper tray 72 which respectively accommodate sheets of copy paper of different sizes. The size and directional orientation (set direction) of the paper accommodated in each paper, tray is detected by size sensor switches 81 and 82. The direction in which the original document is set (orientation) is displayed on the operation panel described later based on the detection signals generated by size sensors 81 and 82.

The copy paper sheets accommodated within tray 71 are pulled out of the tray by take-up roller 711, and thereafter transported to the timing roller set 73 in the image forming portion via roller sets 712 and 713. The copy paper sheets accommodated within tray 72 are pulled out of the tray by take-up roller 721, and thereafter transported to timing roller set 73.

The fed sheet is stopped at the timing roller set 73 position after being detected by a sensor 80 disposed prior to said timing roller set 73. Thereafter, the sheet is transported between the photoconductive drum 61 and transfer charger 67 based on a specific timing signal transmitted from the optical unit, and the image forming process is executed.

A manual feed tray 730 is provided above tray 71 so as to be capable of opening and closing, the opening and closing of said tray being detected by a sensor switch not shown in the drawing.

In the present embodiment of the invention, the manual feed copy mode is set when the aforesaid sensor switch detects that the manual feed tray 730 is in the open state. However, the manual feed mode may also be set automatically when a copy sheet is manually inserted into the paper feed opening, or may also be set by means of a special mode setting key.

A sheet which is inserted from the manual feed tray 730 is automatically transported by rollers 731, and the image forming process is executed.

ADF 300 is provided with a document placement section 301, document transporting section 302, and a document inverting section 303.

When the 2-in-1 mode is set, the ADF 300 transports two single-sheet original documents in succession from the document placement section 301 onto the document platen 8. The second of the two transported single-sheet original documents is disposed so as to have its trailing edge referenced to the position of document scale S. Also, the first of the two transported single-sheet original documents is disposed so as to have its trailing edge coincide with the leading edge of the second transported document. Thereafter, the two single-sheet original documents are regarded as a single document for the scanning process during which the document image exposure is executed. Document placement section 301 has a document tray 313, take-up roller 311, drive motor M3 for the take-up roller 1, and a document sensor 350 for detecting the presence of an original document on said tray 313.

The document transporting section 302 positions the document transported from the placement section 301 at a specific position on the document platen 8, and discharges the document after the copy process is completed.

Document transporting section 302 is provided with a transport belt 319, belt drive motor M2, document feed sensor 351 for detecting the passage of the leading and trailing edges of a fed document, and a discharge tray 321 is disposed thereabove. The document feed sensor 351 may also be arranged with a document size sensor.

Document inverting section 303 inverts two-sided documents transported from the transporting section 302, and returns said inverted document back to the said transport section 302.

Document inverting section 303 is provided with an inverting belt 315, belt drive motor M3, switching lever 323, and document passage sensor 352.

A document may either be discharged from the transporting section 302 to discharge tray 321, or diverted and transported to the inverting section 303 by means of a switching lever 323 actuated by a solenoid.

The ADF 300 starts to transport an original document, for example, when an ADF start signal is transmitted from the control central processing unit (CPU) located within the copier, whereupon the original document is set at a specified position on the document platen 8, and the subsequent operation is accomplished with a specified timing via document positioning signals transmitted to the aforesaid CPU.

Figure 2:
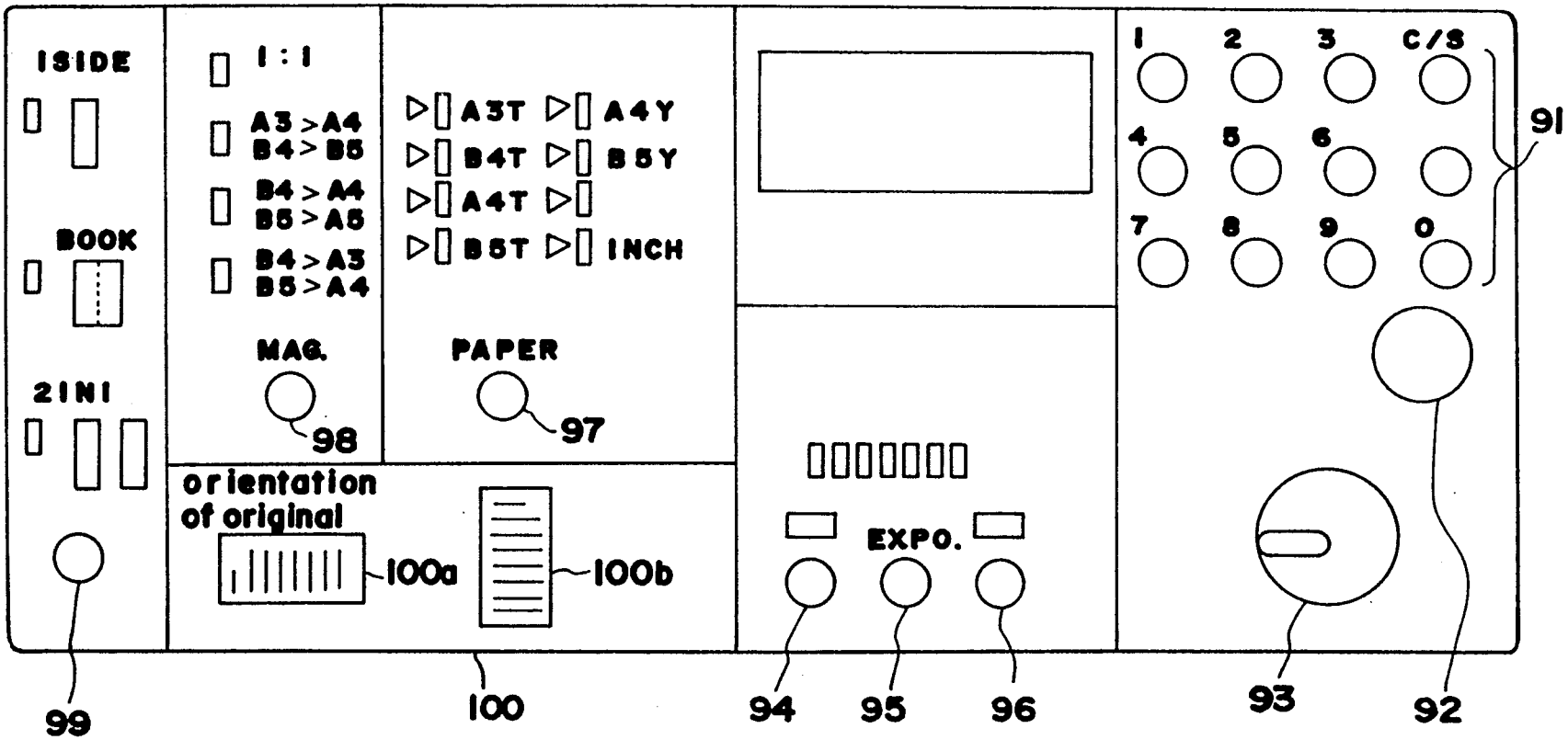
FIG. 2 is a top view of the copier operation panel.

FIG. 2 is a top view of the copier operation panel.

Figure 4B:
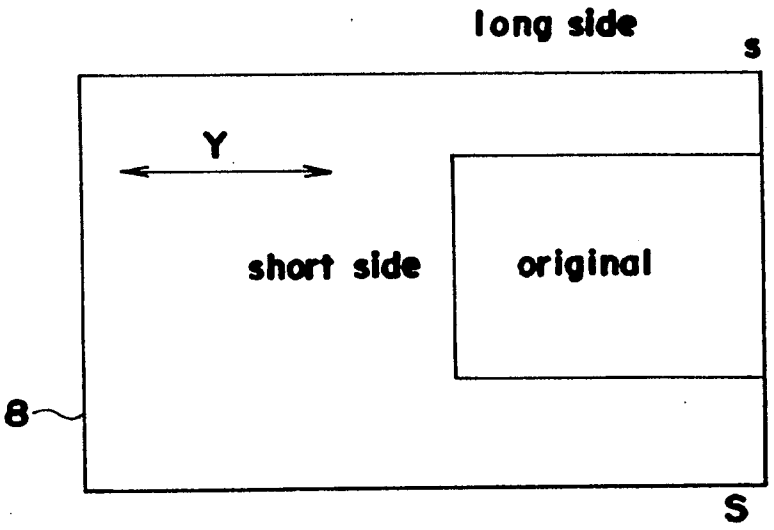
FIGS. 4*a* and 4*b* are illustrations explaining the document orientation directions.
Figure 4A:
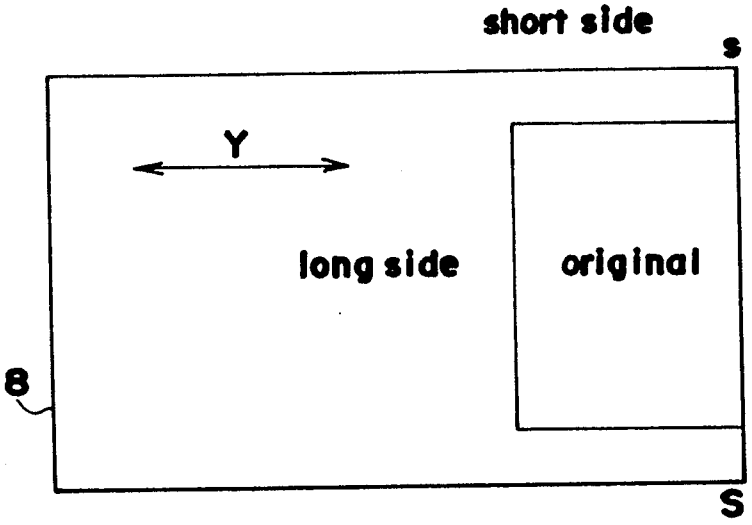
Figures 5A, 5B, 5C, 5D:
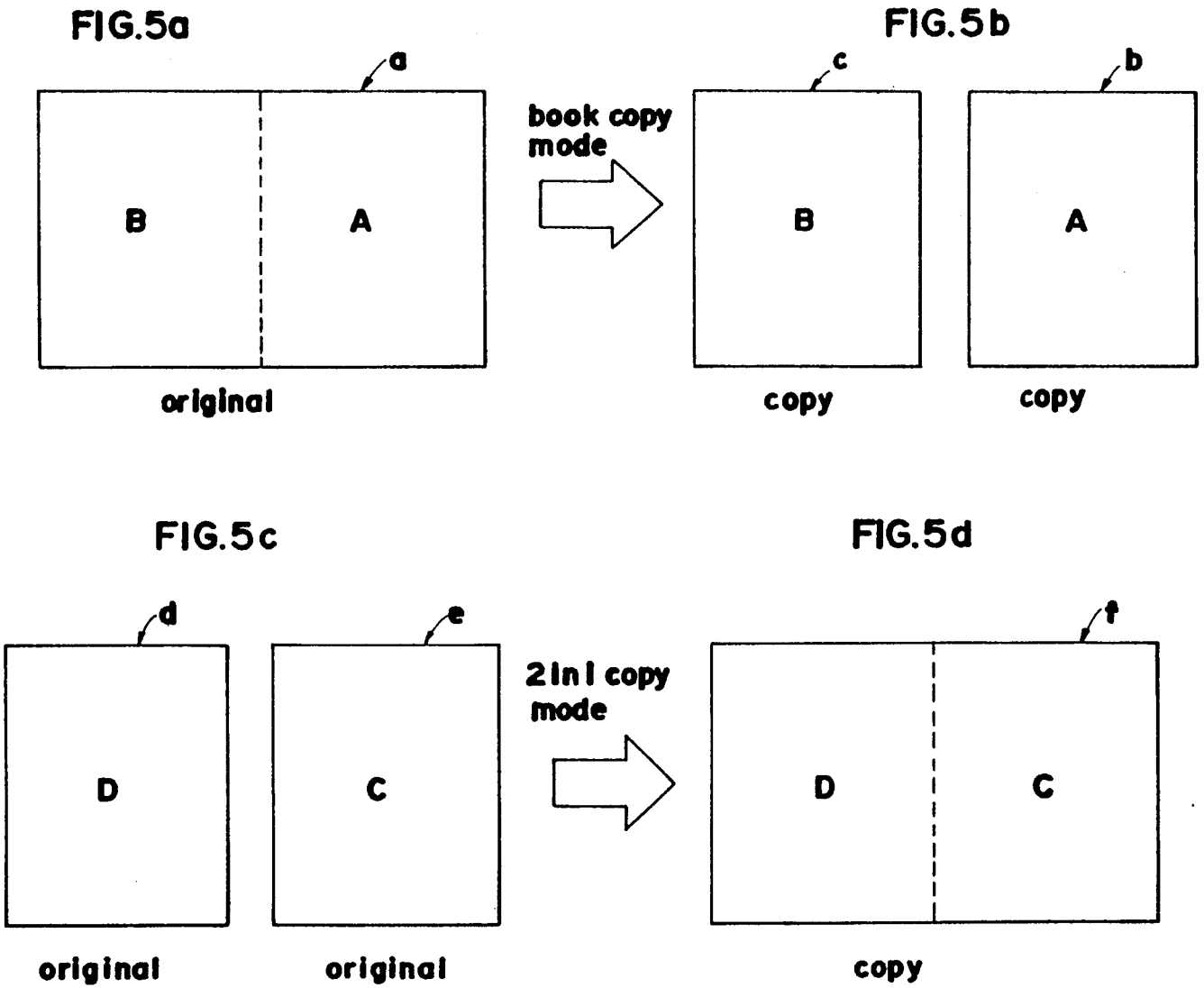
FIGS. 5*a*–5*d* are illustrations explaining the book copy mode and 2-in-1 copy mode.

The operation panel is provided with a key unit 91 comprising a ten-key numerical input pad having numerical keys 0–9, and CLEAR/STOP and INTERRUPT keys, a reset key 92 for executing instructions to reset all modes to their initialization states, START key 93 for executing instructions for the start of the copy operation, auto exposure key 95 for executing instructions to implement the mode for automatically setting the amount of exposure, exposure UP key 94 for executing instructions to increase the amount of exposure, exposure DOWN key 96 for executing instructions to decrease the amount of exposure, document orientation display 100 to indicate by ON/OFF switching whether the orientation of the original document is in the "lengthwise" direction or "widthwise" direction (refer to FIG. 4), PAPER key 97 for selecting the size and directional orientation of the copy sheet, MAG key 98 for selecting the copy magnification, and MODE selection key 99 for selecting the NORMAL, BOOK and 2-in-1 copy modes.

The selected copy mode, copy magnification, and copy sheet size and orientation are indicated by lighting LED lamps arranged near the respective displays. Item **100*a* is a special LED display for indicating "lengthwise orientation" and item 100*b*** is a special LED display for indicating "widthwise orientation."

Above the exposure setting keys 94 through in the middle of the drawing is provided a liquid crystal display section to accommodate a numerical display or the like.

Figure 3:
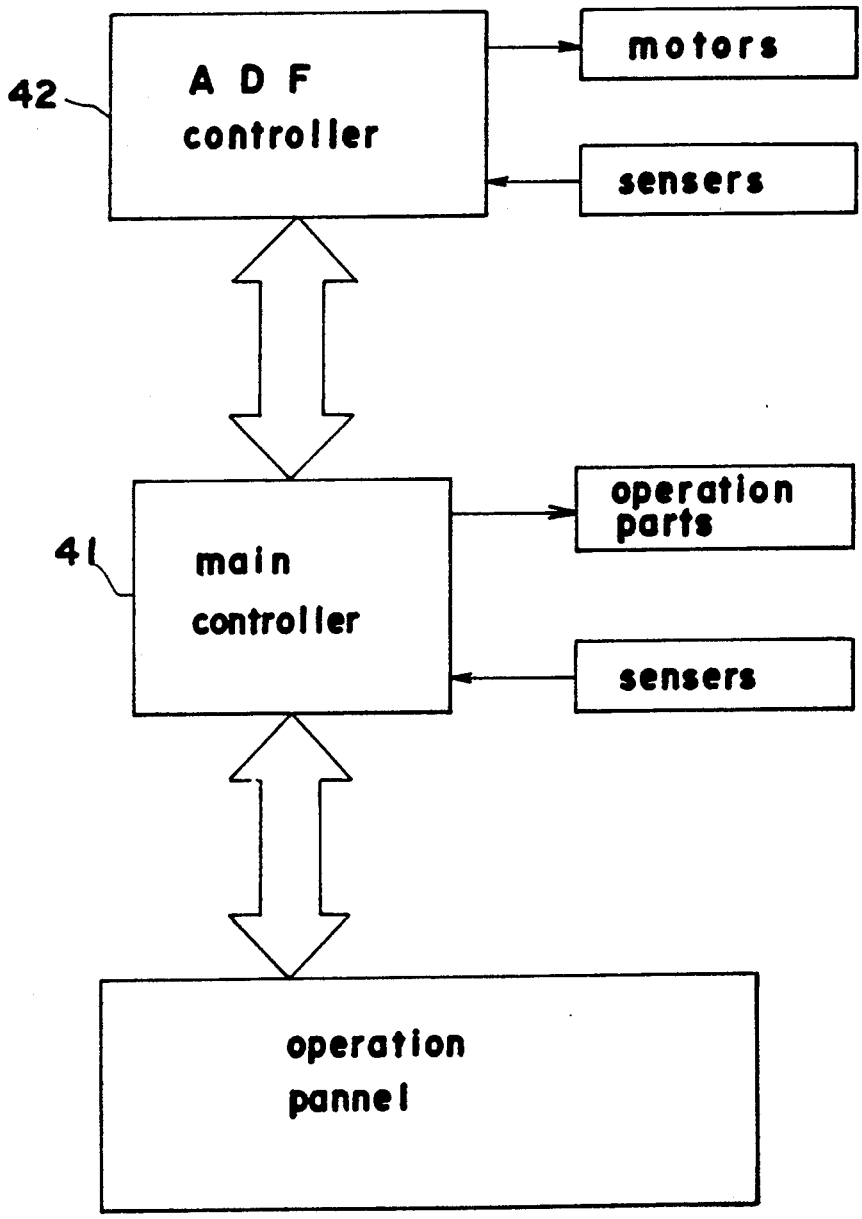
FIG. 3 is a block diagram of the copier control circuit.

FIG. 3 is a block diagram showing the construction of the copier control circuit.

As shown in the drawing, the control circuit comprises two core controllers: a main controller 41 for controlling the operation of the copier, and an ADF controller 42 for controlling the operation of the ADF.

The main controller 41 receives input signals transmitted from the keys on the operation panel, and from the various sensors arranged within the copier.

The various types of actuating control signals are output from the main controller 41 to the various displays on the control panel and various display elements, and to the various operating sections within the copier.

On the other hand, the ADF controller 42 receives the various signals output by the various sensors (sensors 351, 350 and the like) arranged at various locations in the ADF, and outputs drive control signals to the drive motors for the ADF transport belt, feed roller and the like.

The aforesaid main controller 41 and ADF controller 42 are capable of intercommunication, and execute control as described hereinafter.

The operation of the apparatus of the present embodiment is described below with respect to the processing performed by the CPU of the main controller 41.

Figure 6:
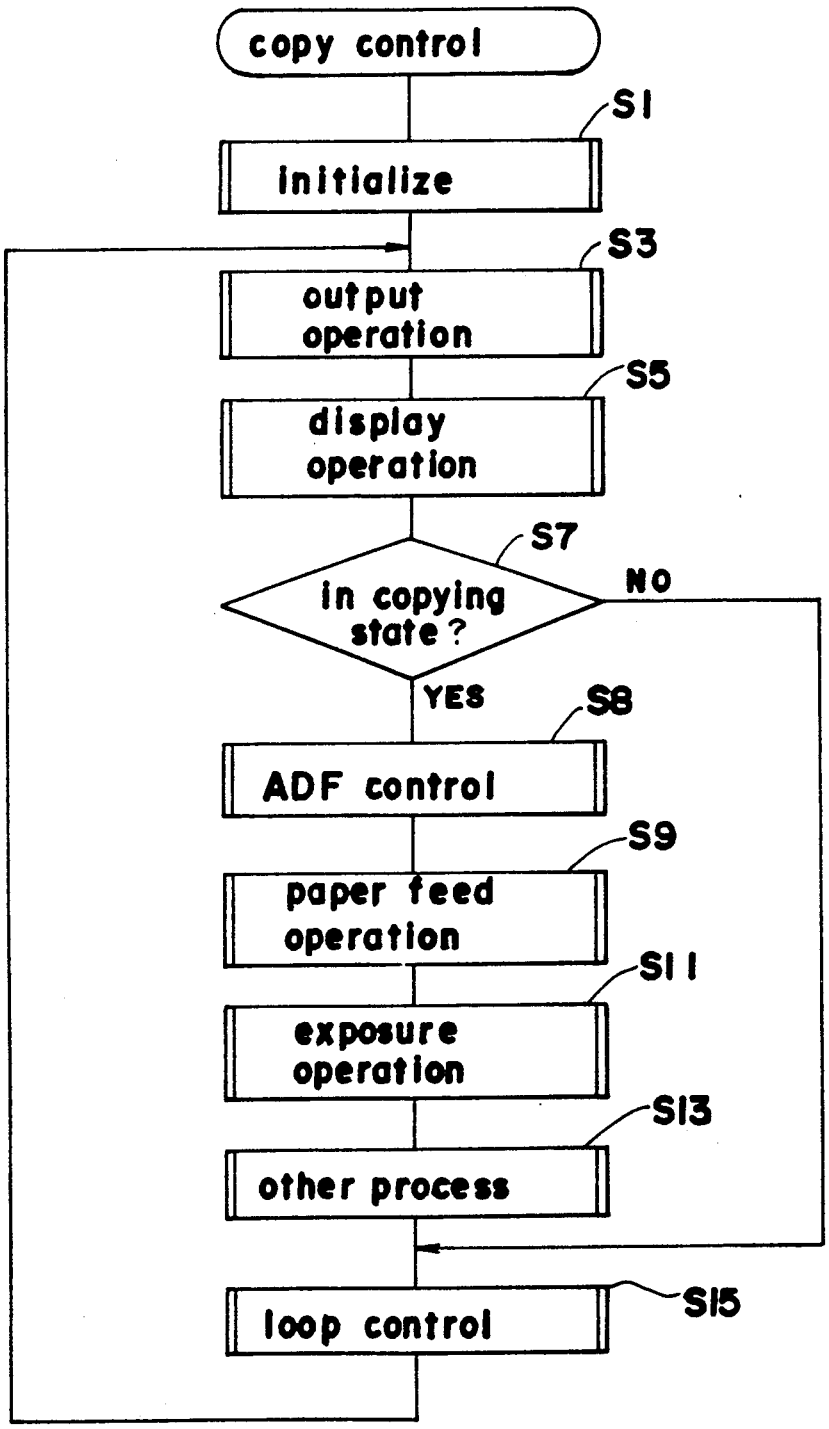
FIG. 6 is a flow chart showing the main routine process of the main controller.

FIG. 6 is a flow chart showing the main routine of the processing performed by the aforesaid The control CPU of main controller 41 starts processing when, for example, power is applied thereto, whereupon each register and flag is initialized (step S1).

In step S3, the output operation routine is executed (processing executed according to the various signals input to the control CPU). In step S5, the display operation routine is executed to control the displays on the operation panel.

In step S7, a check is made to determine whether or not the copy function is enabled, and when the copy function is found to be enabled (or a copy operation is in progress) the result in step S7 is YES, and the ADF control operation (S8), paper feed and transport operations (S9), exposure operation (S11), and other copy operations (S13) are executed. Then, in step S15, the main routine loop management is performed, and the completion of each specific routine timers is awaited, and when said timer are completed the routine returns to step S3.

The output operation routine (S3), display operation routine (S5), and ADF control routines are described in detail hereinafter.

The paper feed and transport operation (S9), exposure operation (S11), and other copy operations (S13) are common knowledge and thus omitted herein.

Figure 7A:
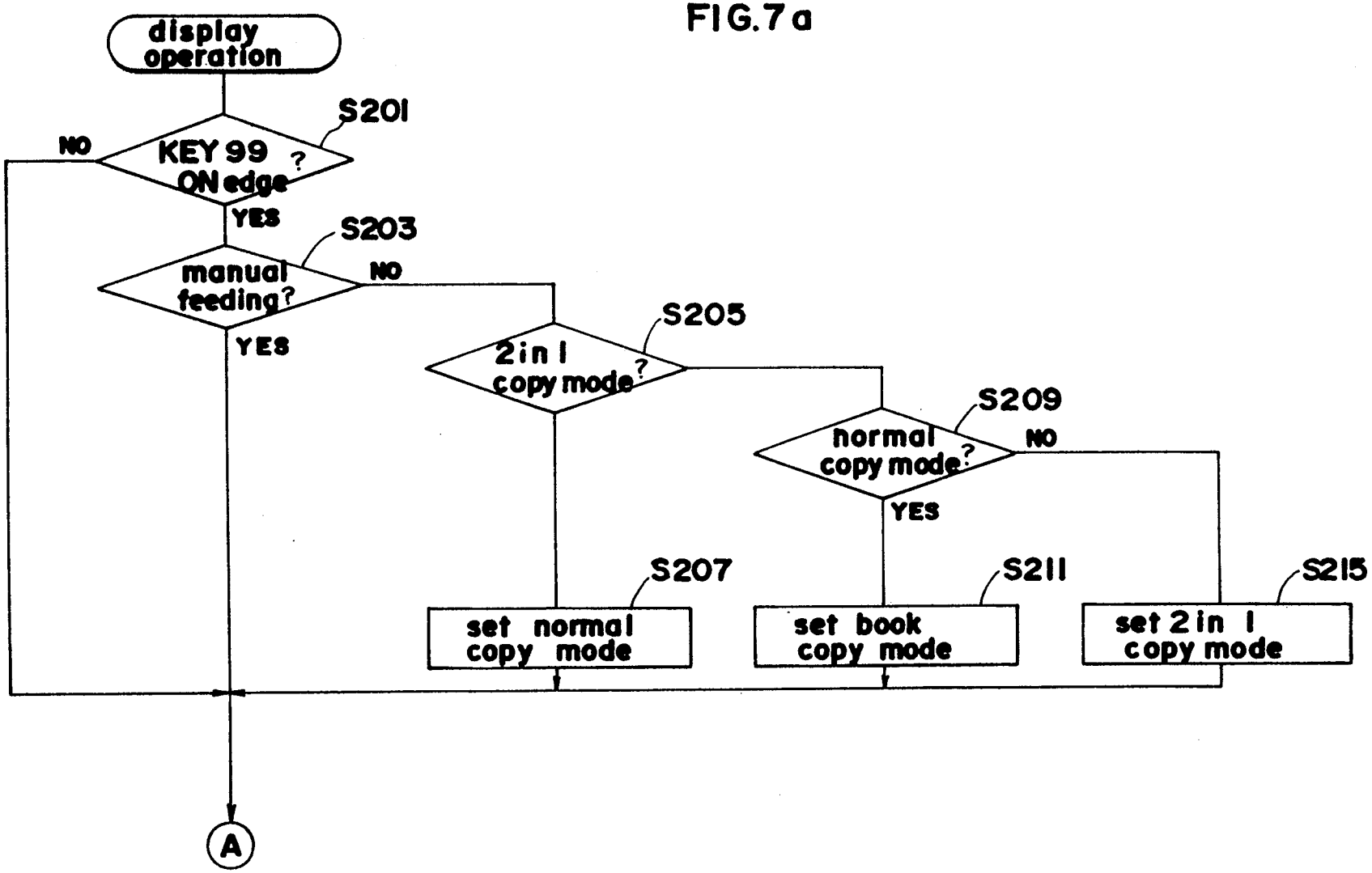
FIGS. 7*a* and 7*b* are flow charts showing the subroutines of the input process.
Figure 7B:
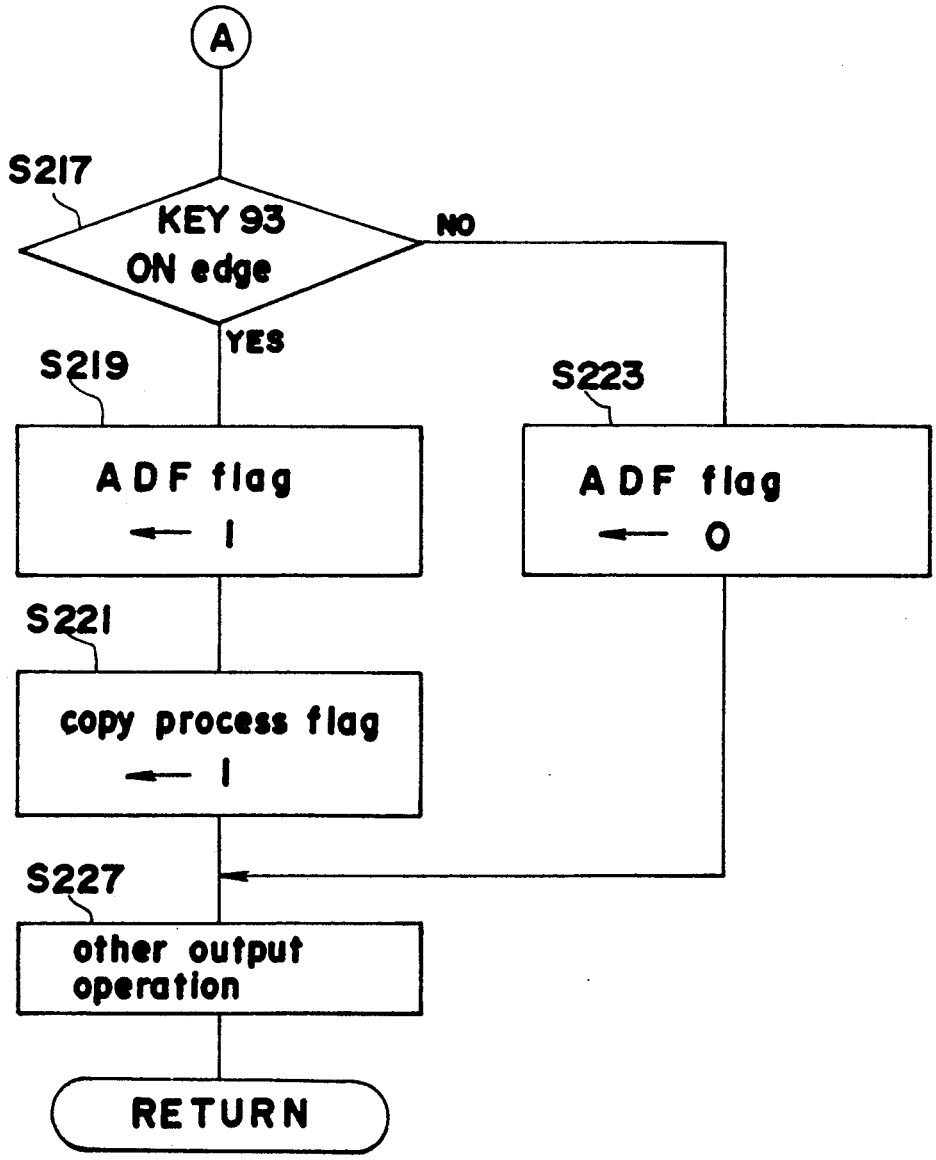

FIGS. 7*a* and 7*b* are flow charts showing the output operation (S3).

The operation of key 99 for switching among the NORMAL, BOOK and 2-in-1 copy modes, and the START key operation are described below. Other operations based on key input and sensor input are omitted.

In step S201, a determination is made as to whether or not key 99 is ON EDGE. ON EDGE is the state of change when the signal state changes from OFF to ON.

When key 99 is detected to be ON EDGE (result of inquiry in step S201 is YES), the mode change operation is executed in accordance with the set mode at that time. That is, if the manual feed mode is the set mode in step S203, then no further action is taken and the routine continues to step S217.

When the 2-in-1 copy mode is set (result of inquiry in step S205 is YES), the mode is reset to the NORMAL copy mode (S207); when the NORMAL copy mode is set (result of inquiry in step S209 is YES), the copy mode is reset to the BOOK copy mode (step S211); when the BOOK copy mode is set (result of inquiry in step S209 is NO), the copy mode is reset to the 2-in-1 copy mode (step S215).

If the manual feed mode is selected (result of inquiry in step S203 is YES) when key 99 is not found to be in the ON EDGE state in step S201, or even when key 99 is found to be in the ON EDGE state, the program jumps steps S205 through S215, and continues to step S217.

In step S217 the START key 9 is checked to detect the ON EDGE state.

When the START key 92 is found to be ON EDGE (result of inquiry in step S217 is YES), the ADF flag to start the ADF operation and the main copy operation flag are both set (steps S219 and S221). These flags are both reset in the main routine when the copy operation is completed.

On the other hand, when the ON EDGE state of START key 99 is not detected (result of inquiry in step S217 is NO), the ADF start signal ON EDGE flag is reset (step S223).

Step S22 is the step in which other operations are executed as a batch according to other signal inputs (excluding those described above). The other signal inputs are, for example, signal input from other keys, manual tray operation sensor input, and signal input from ADF controller 42 (input to the ADF from the document orientation sensor and the like).

Following the aforesaid operation, the program returns to the main routine.

Figure 8:
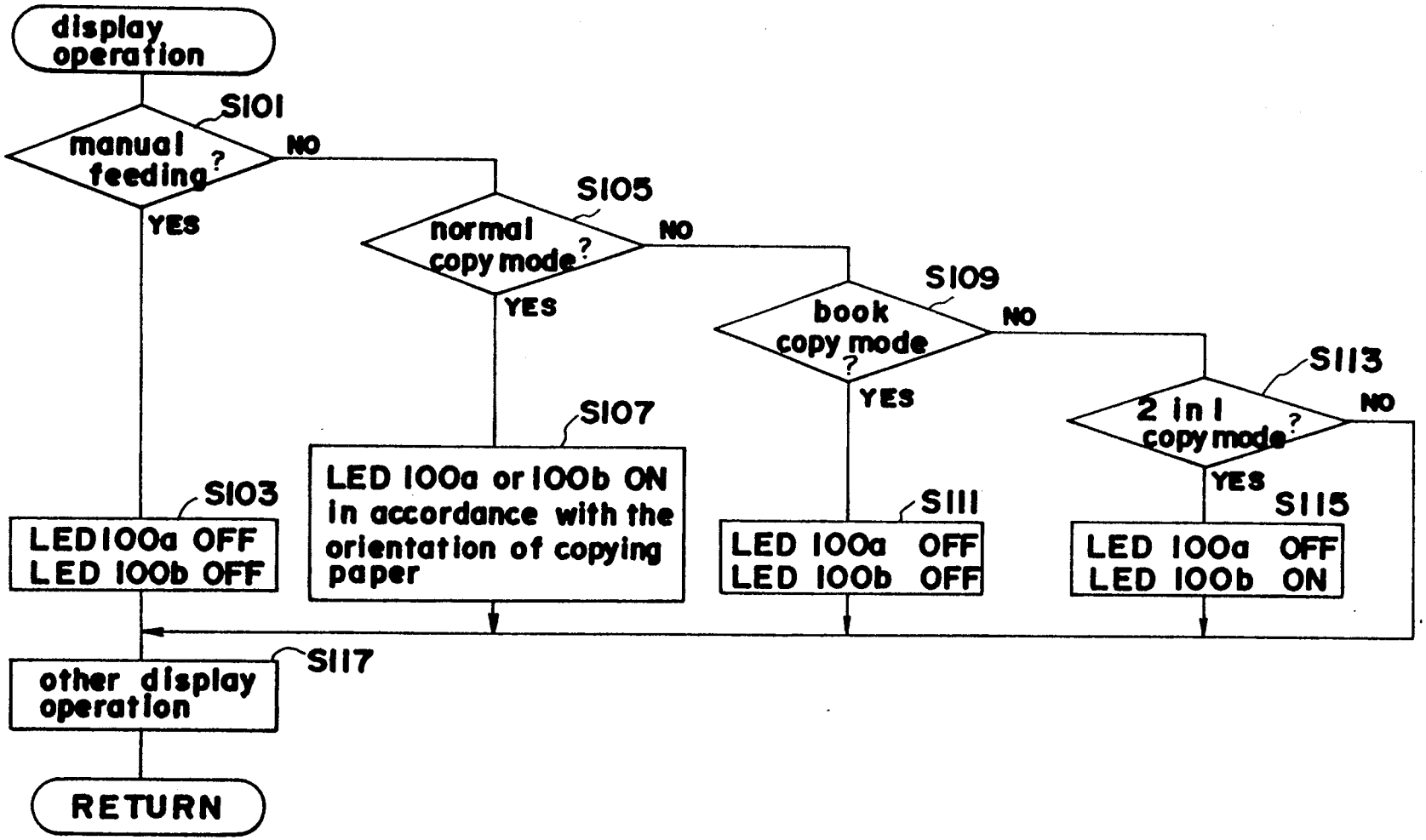
FIG. 8 is a flow chart showing the subroutine for the display process.

FIG. 8 is a flow chart showing the display operation routine (S5).

When the manual feed port is selected as the sheet feeder path, i.e. when the manual tray is opened (the result of the inquiry in step S101 is YES), the document orientation display is switched OFF (step S103). In this case the document orientation display is switched OFF whether it is the lengthwise or widthwise orientation display (LED 100*a* is OFF and LED 100*b* is OFF) because the copy sheet orientation cannot be determined.

On the other hand, if the it is determined in step S101 that the manual feed path has not been selected, the document orientation display is controlled so as to switch among the NORMAL, BOOK and 2-in-1 copy modes.

In other words, when the NORMAL copy mode is set (the result of the inquiry in step S105 is YES), the same directional orientation as the copy sheet is displayed as the orientation of the original document (step S107). In this case a conventional display is permissible because copy sheet and the original document are always set in the same direction.

When the BOOK copy mode is set (the result of the inquiry in step S109 is YES), the document orientation display is switched OFF (LED 100*a* is OFF and LED 100*b* is OFF) in step S111. This arrangement is specified because if either of the aforesaid LEDs are lighted it is difficult to differentiate whether the display direction specifies a full book (two pages of the open book) or a half book (the book is opened but only one page is set copying) orientation.

When the 2-in-1 copy mode is set (the result of the inquiry in step S113 is YES), the widthwise direction is displayed on the document orientation display (LED 100*a* is OFF and LED 100*b* is ON) in step S115.

This arrangement is specified because in the case of the 2-in-1 copy mode the orientation of each original document is typically in the widthwise direction so as to not confuse the operator.

Then, in step S117, display operations other than those described above are executed as a batch, and thereafter the program returns to the main routine.

Figure 9:
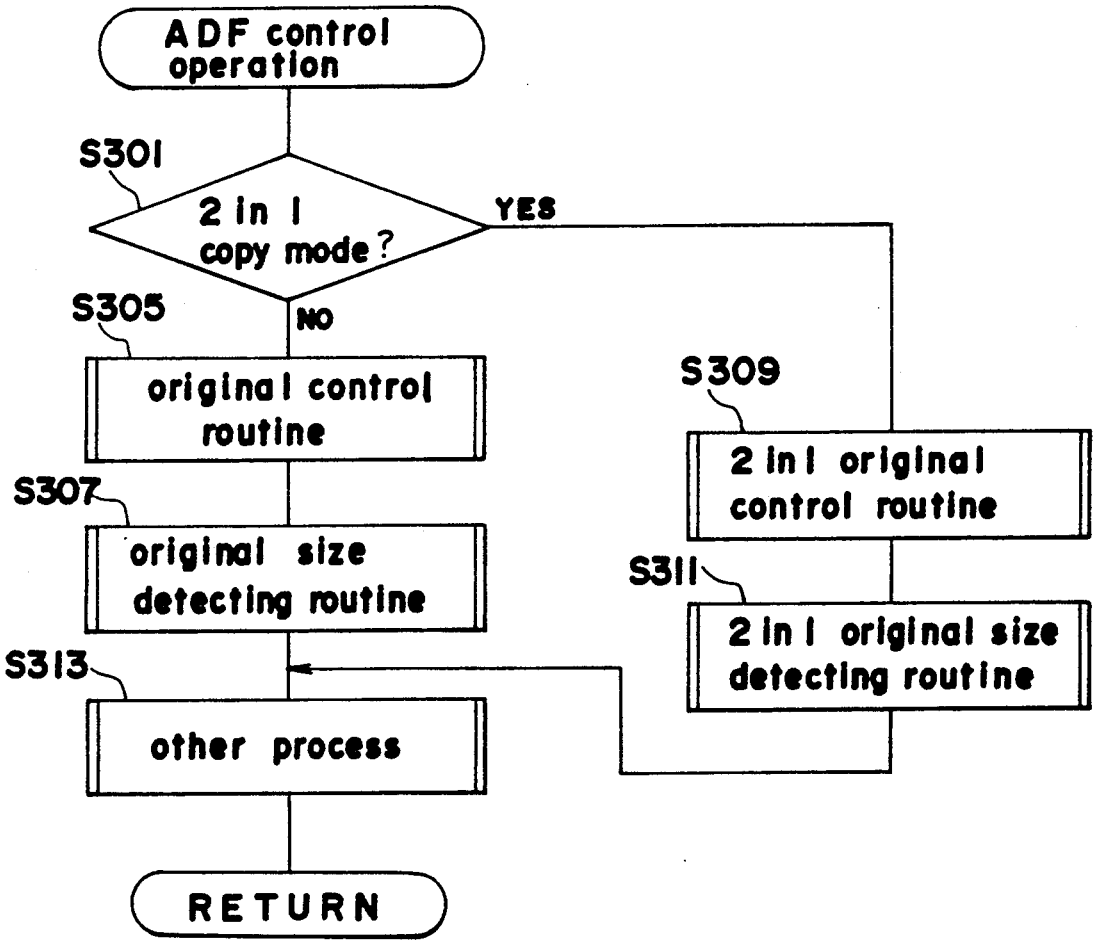
FIG. 9 is a flow chart showing the subroutine for the ADF control process.

FIG. 9 is a flow chart showing the routine of the ADF control operation in step S8.

In the ADF control operation, operation is switched to the document control and size detecting routines depending on whether or not the 2-in-1 copy mode has been set.

When the 2-in-1 copy mode is set (the result of the inquiry in step S301 is YES), the 2-in-1 document control routine in step S309 and the 2-in-1 document size detecting routine in step S311 are executed. If the 2-in-1 copy mode has not been set (the result of the inquiry in step S301 is NO), the document control routine in step S305 and the document size detecting routine in step S307 are executed.

Step S313 is the step wherein processes other than the ADF control operation are executed as in a batch.

The program returns to the main routine following the previously described operation.

Details of the 2-in-1 document control routines and the 2-in-1 document size detecting routines are described hereinafter with reference to the accompanying time charts and flow charts.

Figure 10A:
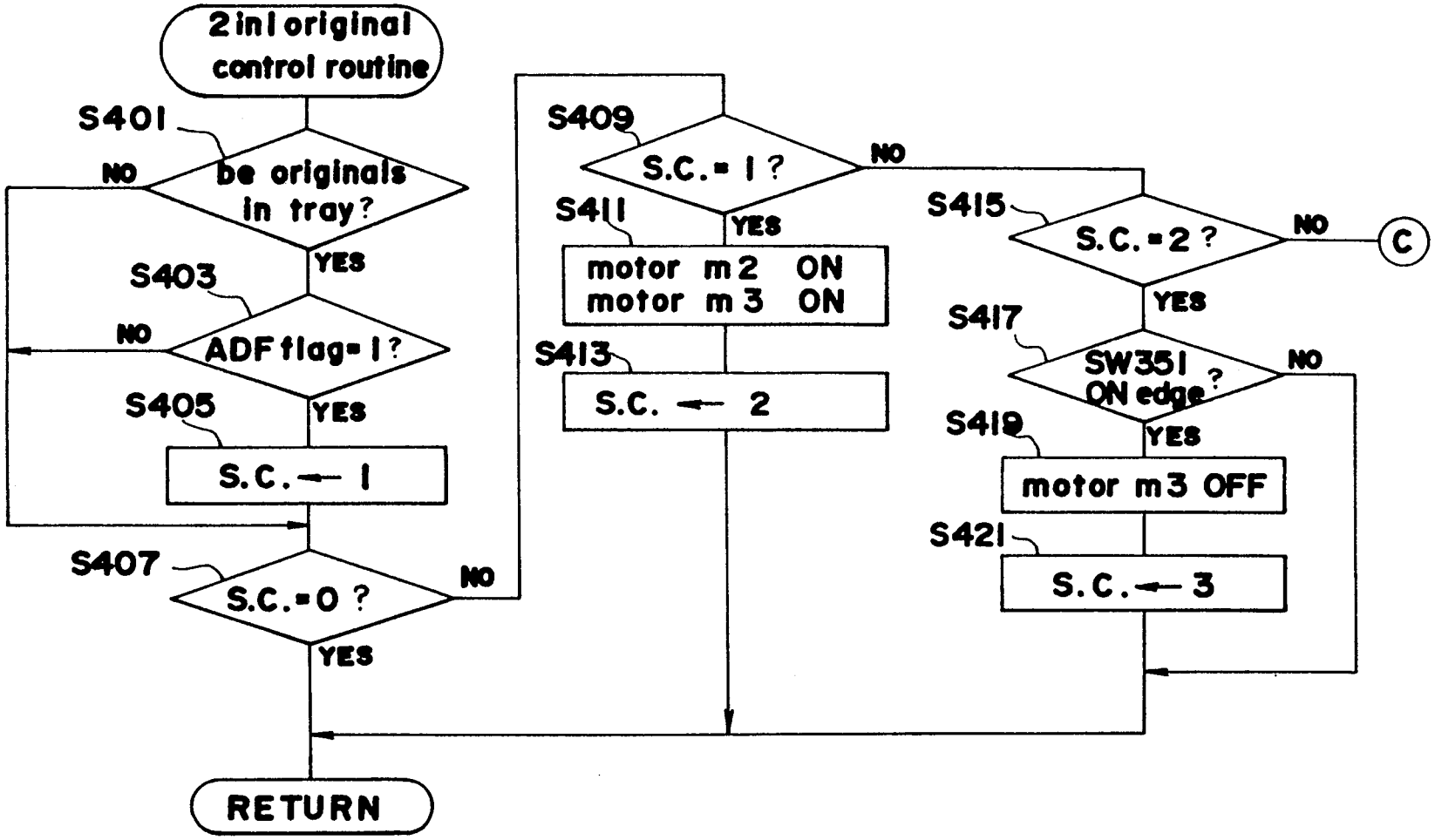
FIGS. 10*a* and 10*b* are flow charts showing the 2-in-1 document control routine.
Figure 10B:
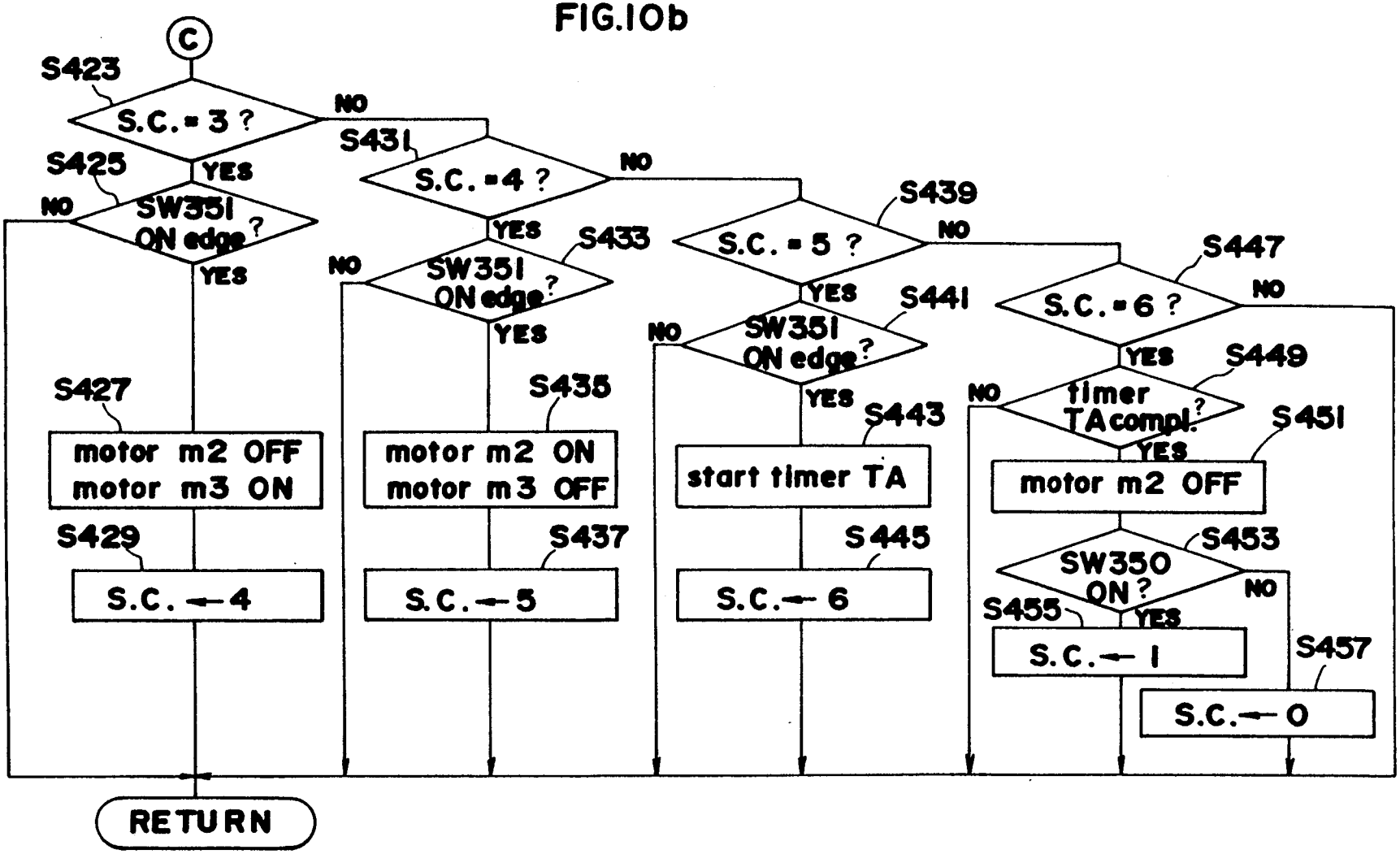
Figure 12:
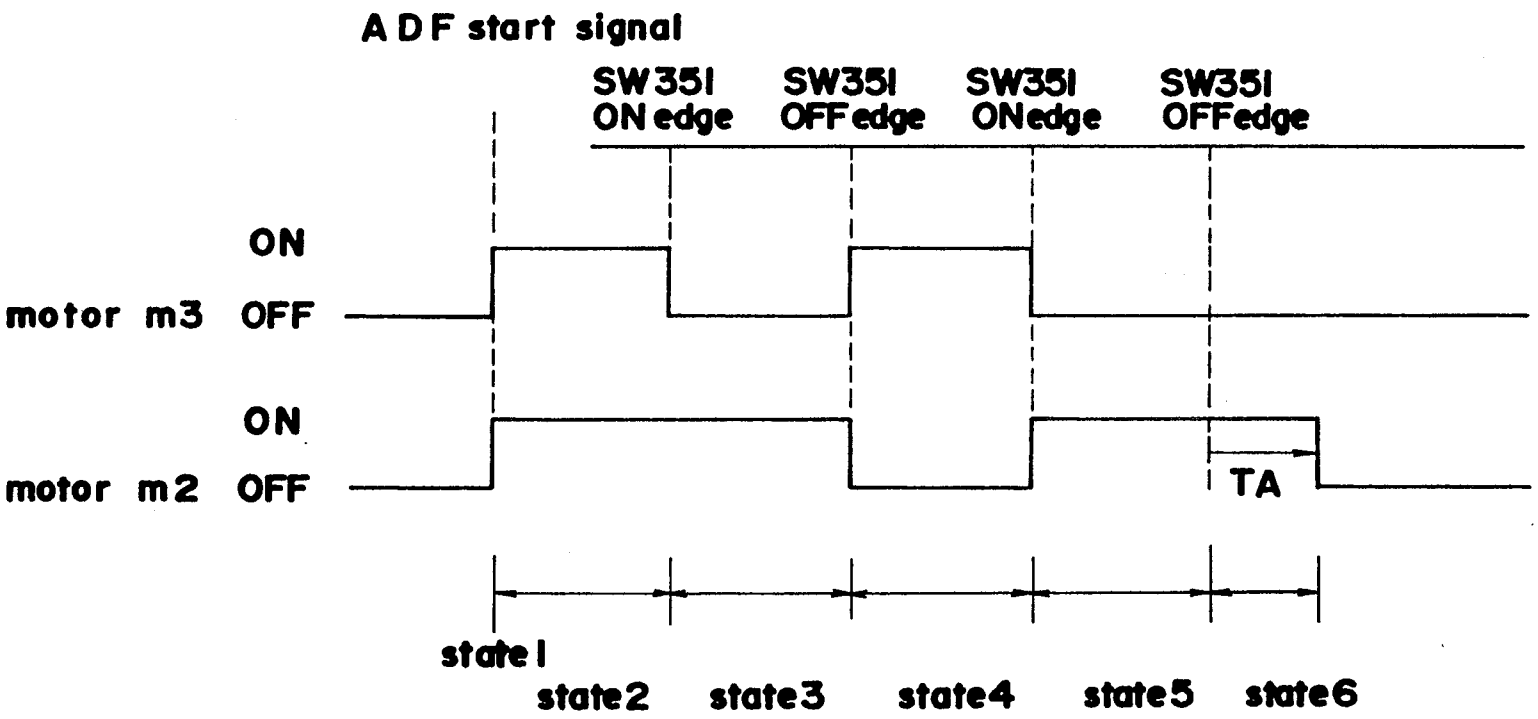
FIG. 12 is a time chart showing the correspondences between the states shown in FIGS. 11*a* and 11*b* and the ON/OFF edge status of switch SW351.

FIGS. 10*a* and 10*b* are flow charts showing the process of the 2-in-1 document control routine (step S309) called u in the ADF control routine. In addition, FIG. 12 is a timing chart showing correspondence between the state indicated in FIGS. 10*a* and 10*b* and the ON/-OFF states of switch 351 in FIG. 1.

When the ADF flag has been set (result of the inquiry of in step S403 is YES) by the placement of an original document on the ADF document tray 313 (the result of the inquiry in step S401 is YES), a state counter is set at 1 in step S405. The state counter value is reset to 0 (zero) at initialization. In step S407 and steps subsequent thereto, processing is switched and executed in accordance with the registered state counter value. Each process of the state counter is described below.

* State Counter=0

The program returns to the ADF control operation without other change.

* State Counter=1

The transport belt motor M2 and document feed motor M3 are switched (step S411), the state counter is set at 2 (step S413), and the program returns to the ADF control routine.

* State Counter=2

Detection of the ON EDGE state of document feed sensor 351 is awaited (result of inquiry in step S417 is YES), the document feed motor M3 is switched OFF (step S419), the state counter is set at 3 (step S421), and the program returns to the ADF control routine.

* State Counter=3

Detection of the ON EDGE state of document feed sensor 351 is awaited (result of inquiry in step S425 is YES), the transport belt motor M2 is switched OFF, and the document feed motor M3 is switched ON. Then the state counter is set at 4 (step S429) and the program returns to the ADF control routine.

* State Counter=4

Detection of the ON EDGE state of document feed sensor 351 is awaited (result of the inquiry in step S433 is YES), the transport belt motor M2 is switched ON, and the document feed motor M3 is switched OFF (step S435). Then the state counter is set at 5 (step S437) and the program returns to the ADF control routine.

* State Counter=5

Detection of the ON EDGE state of document feed sensor 351 is awaited (result of inquiry in step S441 is YES), and the timer TA is started (step S443). Then the state counter is set at 6 (step S445). Timer TA regulates the time during which the trailing edge of the original document, which has already passed the document feed sensor 351, is positioned at a specified position.

Thereafter, the program returns to the ADF control routine.

* State Counter=6

A condition for the completion of timer TA (result of the inquiry in step S449 is YES) is that the transport belt motor M2 is switched OFF (step S451). When the document sensor 350 is switched ON (result of the inquiry in step S453 is YES), the state counter is set at 1 (step S455). On the other hand, when the document sensor 350 is switched OFF (result of the inquiry in step S453 is NO), the state counter is set at 0 (zero) (step S457).

Thereafter, the program returns to the ADF control routine.

If the state counter does not register any number 0 through 6 (the result of the inquiry in step S447 is NO), the program returns to the ADF control routine without further change.

Figure 11:
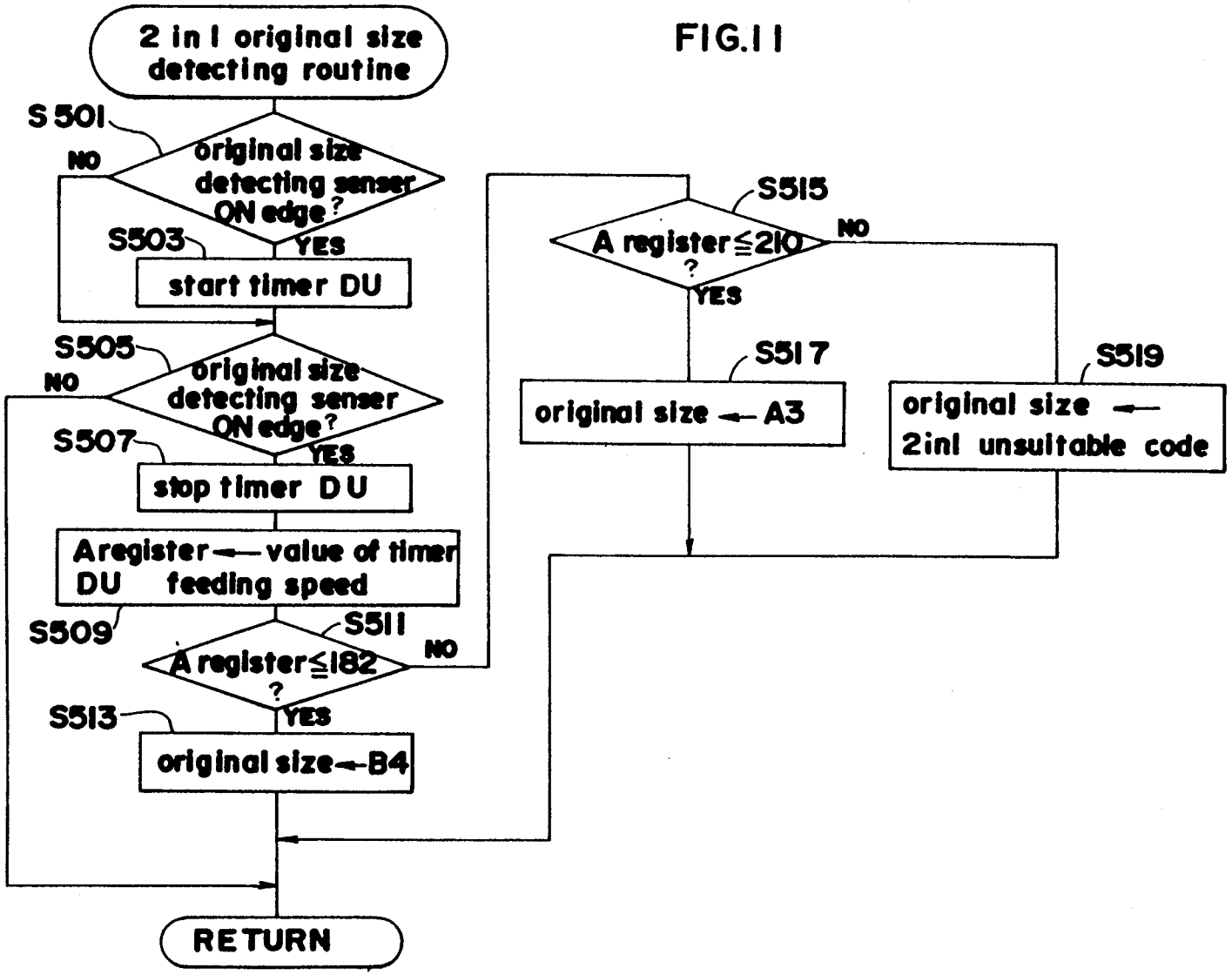
FIG. 11 is a flow chart showing the 2-in-1 document size detecting routine.

FIG. 11 is a flow chart showing the process of the 2-in-1 document size detecting routine (S311) called up in the ADF control routine (S8).

Detection of the ON EDGE state of the document size sensor 351 is awaited (result of the inquiry in step S501 is YES), and the timer DU is started (step S503).

Subsequently, when the OFF EDGE state of the aforesaid document size sensor 351 is detected (result of the inquiry in step S505 is YES), timer DU is stopped (step S507), and the product of the time for the document passage calculated by the timer DU and the document transport speed (the product equals the length of the original document in the transport direction) is assigned to the A-register (step S509).

The determination of the 2-in-1 copy mode document size is based on the document size (original document size in the transport direction) assigned to the A-register.

* A-register≦182

When the value assigned to the A-register is 182 mm or less (e.g., the length of the short side of a B5 sheet or less) (the result of the inquiry in step S511 is YES), B4/lengthwise is set as the 2-in-1 copy mode original document size (step S517).

* A-register≦210

When the value assigned to the A-register is 210 mm or less (e.g., the length of the short side of an A4 sheet or less) (the result to the inquiry in step S515 is YES), A3/lengthwise is set as the 2-in-1 copy mode original document size (step S517).

* A-register>210

When the value assigned to the A-register is greater than 210 mm (e.g., greater than the short side of an A4 sheet) (the result of the inquiry in step S515 is NO), the 2-in-1 copy mode incompatibility code is set because the original document is unsuitable for the 2-in-1 copy mode (step S519).

Thus, the control of the present embodiment of the invention is executed as described above.

According to the description of the previously mentioned embodiment, the present invention is capable of indicating the 2-in-1 copy mode, and displays the directional orientation of an original document sheet by sheet while it does not display the directional orientation of aligned two-page original documents. Thus, original documents can be set without operator confusion.

Another embodiment of the present invention is described hereinafter with reference to the accompanying FIGS. 13*a* and 13*b*.

The second embodiment of the invention is substantially the same as the previously described first embodiment, with the exception of steps S111 and S115 in the display operation flow chart (refer to FIG. 8).

In the second embodiment the process of step S11 has been changed to the process of step

Figure 13A:
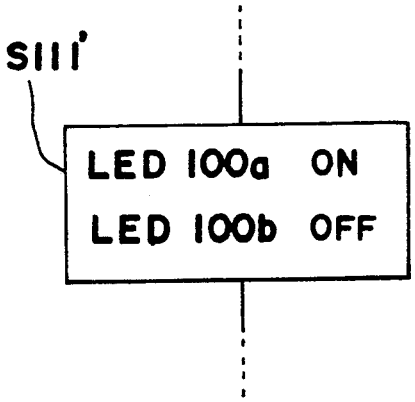
FIGS. 13*a* and 13*b* are illustrations showing another example of the flow chart in FIG. 8.
Figure 13B:
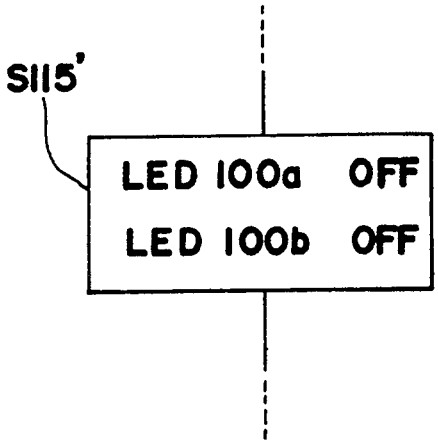

S111' shown in FIG. 13*a*. Also in the second embodiment the process in step S115 has been changed to the process in step S115' shown in FIG. 13*b*.

According to the second embodiment, when the BOOK copy mode is set, the "lengthwise direction" is displayed as the original document orientation. Thus, this arrangement is provided because if the entirety of an original document (mainly the two pages of an opened book) is placed on the document platen as a single original document, the original document orientation will be in the lengthwise direction.

Further, when the 2-in-1 copy mode is set, the original document orientation display is switched OFF. This arrangement is provided because when the direction in which the original document is set is displayed, confusion may arise as to whether the displayed direction indicates the orientation of a two-page original document on the document platen or the orientation of each single page of the original document.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus capable of indicating document orientation for a reference to set an original document on a document platen, comprising:

a document orientation display means for displaying document orientation, said document orientation display means displaying, in a normal copy mode of the apparatus, document orientation in a normal display form in which the displayed document orientation coincides with an orientation of a copy sheet to be fed;

a mode setting means for setting a specific copy mode of the apparatus that differs from the normal copy mode of the apparatus; and a control means for controlling the document orientation display means when the specific copy mode is set by the mode setting means to display document orientation in a specific display form in which the displayed document orientation does not coincide with an orientation of a copy sheet to be fed.

2. An image forming apparatus of claim 1 further comprising a reproducing means for reproducing images of documents set on a document platen onto a copy sheet, said reproducing means when at said specific copy mode reproducing from two original documents simultaneously set on a document platen to a single copy sheet.

3. An image forming apparatus of claim 1 further comprising a reproducing means for reproducing images of documents set on a document platen onto a copy sheet, said reproducing means when at said specific copy mode reproducing copies from one original document having two image regions such that image of one region is reproduced on one copy sheet and image of the other region is reproduced on another copy sheet.

4. An image forming apparatus of claim 2, wherein said document orientation display means is adjacently provided to the document platen.

5. An image forming apparatus capable of indicating document orientation for a reference to set an original document on a document platen, comprising:

a document orientation display means for displaying document orientation, said document orientation display means displaying the document orientation at a normal copy mode in a normal display form in which the document orientation coincides with an orientation of a copy sheet to be fed;

a mode setting means for setting a specific copy mode in which the document orientation is different from an orientation of a fed copy sheet; and a control means for deactivating the document orientation display means when the specific copy mode is set by the mode setting means.

6. An image forming apparatus of claim 5 further comprising a reproducing means for reproducing images of documents set on a document platen onto a copy sheet, said reproducing means when at said specific copy mode reproducing from two original documents simultaneously set on a document platen to a single copy sheet.

7. An image forming apparatus of claim 5 further comprising a reproducing means for reproducing images of documents set on a document platen onto a copy sheet, said reproducing means hen at said specific copy mode reproducing copies from one original document having two image regions such that image of one region is reproduced on one copy sheet and image of the other region is reproduced on another copy sheet.

8. An image forming apparatus capable of indicating document orientation for a reference to set an original document on a document platen, comprising:

a document orientation display means for displaying document orientation, said document orientation display means displaying the document orientation at a normal copy mode in a normal display form in which the document orientation coincides with an orientation of a copy sheet to be fed;

an automatic document feeding means for feeding original documents set in a document tray to the document platen;

a specific copy mode setting means for setting a specific copy mode wherein two original documents are simultaneously set on the document platen by the automatic document feeding means and images of two original documents are reproduced on a single copy sheet; and a display control means, when the specific copy mode is set by the specific copy mode setting means, for controlling the document orientation display means so as to display an orientation different from that of the fed copy sheet as the document orientation.

9. An image forming apparatus of claim 8, wherein said document orientation display means is adjacently provided to the document platen.

10. An image forming apparatus capable of indicating document orientation for a reference to set an original document, comprising:

a reproducing means for reproducing images of documents set on a document platen onto a copy sheet;

a document orientation display means for indicating an orientation in which an original document is set in accordance with an orientation of a copy sheet to be fed;

an automatic document feeding means for feeding an original document set in a document tray to the document platen;

a specific copy mode setting means for setting a specific copy mode wherein two original documents are simultaneously set on the document platen by the automatic document feeding means and reproduced on a single copy sheet by said reproducing means; and a display control means which displays on a document orientation different from the orientation in which the copy sheet is fed when a specific copy mode is set by the specific copy mode setting means.

11. An image forming apparatus of claim 10, wherein said document orientation display means is adjacently provided to the document platen.

* * * * *

UNITED STATES PATENT AND TRADEMARK OFFICE

CERTIFICATE OF CORRECTION

PATENT NO. : 5,220,395

DATED June 15, 1993

INVENTOR(S) Toshiyuki Yamashita, et al.

It is certified that error appears in the above-identified patent and that said Letters Patent is hereby corrected as shown below:

In col. 1, line 14, change "Arms" to --Arts--.

In col. 3, line 43, change "FIGS. 11a and 11b" to --FIGS. 10a and 10b--.

In col. 4, line 39, between "paper" and "tray", delete --,-- (comma).

In col. 5, line 23, change "take-up roller 1" to --take-up roller 311--.

In col. 6, line 16, after "through" insert --96--.

In col. 6, line 46, after "aforesaid" insert --CPU--.

In col. 6, line 64, change "timer" to --timers--.

In col. 7, line 34, change "key 9" to --key 93--.

In col. 7, line 46, change "S22" to --S227--.

In col. 7, line 66, delete "the" (second occurrence).

In col. 8, line 55, change "u" to --up--.

In col. 10, line 50, change "S11" to --S111--.

In col. 10, line 51, after "step" line 52 should follow.

In col. 12, line 8 (claim 7, line 4), change "hen" to --when--.

UNITED STATES PATENT AND TRADEMARK OFFICE

CERTIFICATE OF CORRECTION

PATENT NO. : 5,220,395

DATED : June 15, 1993

INVENTOR(S) : Toshiyuki Yamashita, et al.

It is certified that error appears in the above-identified patent and that said Letters Patent is hereby corrected as shown below:

In col. 12, following the last line thereof (following line 65), insert the following claims 12 and 13.

--12. An image forming apparatus capable of indicating document orientation for a reference to set an original document, comprising:

a reproducing means for reproducing an image of an original document set on a document platen onto a copy sheet;

an automatic document feeding means for feeding an original document set in a document tray to the document platen;

a document orientation display means for indicating a document orientation in accordance with which original document will be set on the document tray of the automatic document feeding means;

a specific copy mode setting means for setting a specific copy mode wherein two original documents are simultaneously set on the document platen by the automatic document feeding means and reproduced on a single copy sheet by said reproducing means; and

UNITED STATES PATENT AND TRADEMARK OFFICE

CERTIFICATE OF CORRECTION

PATENT NO. : 5,220,395

DATED : June 15, 1993

INVENTOR(S) : Toshiyuki Yamashita, et al.

It is certified that error appears in the above-identified patent and that said Letters Patent is hereby corrected as shown below:

a display control means for controlling said document orientation display means to indicate document orientation different from the orientation of the single copy sheet to be fed in the specific copy mode which is set by said specific copy mode setting means.

13. An image forming apparatus of claim 12, wherein said document orientation display means is provided adjacent to the document platen.--

On the title page, "11 Claims, 15 Drawing Sheets" should read--13 Claims, 15 Drawing Sheets--.

Signed and Sealed this

Fifth Day of April, 1994

Bruce Lehman

*Attest:*

BRUCE LEHMAN

*Attesting Officer*

*Commissioner of Patents and Trademarks*